US006717500B2

(12) United States Patent
Girbachi et al.

(10) Patent No.: US 6,717,500 B2
(45) Date of Patent: Apr. 6, 2004

(54) SURFACE MOUNTABLE ELECTRONIC COMPONENT

(75) Inventors: Catalin Constantin Girbachi, Cary, IL (US); Nelson Garcia, Lake in the Hills, IL (US); Richard D. Rehak, Crystal Lake, IL (US); Chris Caramela, Crystal Lake, IL (US); Scott Hess, Lake in the Hills, IL (US)

(73) Assignee: Coilcraft, Incorporated, Cary, IL (US)

( * ) Notice: Subject to any disclaimer, the term of this patent is extended or adjusted under 35 U.S.C. 154(b) by 0 days.

(21) Appl. No.: 10/131,344

(22) Filed: Apr. 24, 2002

(65) Prior Publication Data

US 2002/0164892 A1 Nov. 7, 2002

Related U.S. Application Data

(60) Provisional application No. 60/286,751, filed on Apr. 26, 2001, and provisional application No. 60/289,100, filed on May 7, 2001.

(51) Int. Cl.[7] ..... H01F 27/02

(52) U.S. Cl. ..... 336/83; 336/212; 336/208; 336/198

(58) Field of Search ..... 336/212, 83, 200, 336/223, 198, 208, 232

(56) References Cited

U.S. PATENT DOCUMENTS

| | | | |
|---|---|---|---|
| 3,199,178 A | 8/1965 | Renskers | |
| 3,332,048 A | 7/1967 | Renskers | |
| 3,368,276 A | 2/1968 | Renskers | |
| 3,390,364 A | 6/1968 | Russell | |

(List continued on next page.)

FOREIGN PATENT DOCUMENTS

| | | | |
|---|---|---|---|
| JP | 58-184815 | 12/1983 | |
| JP | 3263805 | * 11/1991 | ..... 336/200 |
| JP | 06036936 A | * 2/1994 | ..... 336/200 |
| JP | 7-074028 | 3/1995 | |
| JP | 7-288210 | 10/1995 | |
| JP | 1032670 | 12/1998 | |
| JP | 11-54345 | 2/1999 | |
| KR | 2001-0045690 | 6/2001 | |
| WO | WO 92/05568 | 4/1992 | |

OTHER PUBLICATIONS

International Search Report for related International Patent Application No. PCT/US02/13047, p. 1 (Sep. 23, 2002).

*Primary Examiner*—Anh Mai
(74) *Attorney, Agent, or Firm*—Fitch, Even, Tabin & Flannery

(57) ABSTRACT

A low profile electronic component in accordance with the invention includes an elongated core made from a magnetic material such as ferrite, which is connected to a base having a plurality of metalized pads attached thereto for electrically and mechanically connecting the component to a printed circuit board. Support structures or spacers are positioned at the ends of the core and are provided to assist the core in shielding the component and concentrating its magnetic lines of flux. The component also includes a winding of wire wound about at least a portion of the base and core assembly between the supports, and has the ends of the wire electrically and mechanically connected to the metalized pads of the base. A top portion may be coupled to the core via the supports to cover at least a portion of the windings of wire of the component. The supports separate the core and the top portion and maintain the top portion at a desired position with respect to the winding and the core. The core, supports, and top portion provide a source of additional shielding for the component and improve the performance of the overall component by concentrating the lines of flux emitted by the component thereby increasing the flux density of the component and its inductance.

16 Claims, 7 Drawing Sheets

U.S. PATENT DOCUMENTS

| | | | | | |
|---|---|---|---|---|---|
| 3,466,381 | A | | 9/1969 | Boehmke | |
| 3,534,309 | A | | 10/1970 | Renskers et al. | |
| 3,593,217 | A | | 7/1971 | Weber | |
| 3,666,090 | A | | 5/1972 | Johnson et al. | |
| 3,671,905 | A | | 6/1972 | Renskers | |
| 3,676,813 | A | | 7/1972 | Renskers | |
| 3,721,747 | A | | 3/1973 | Renskers | |
| 3,735,214 | A | | 5/1973 | Renskers et al. | |
| 3,743,990 | A | | 7/1973 | Renskers et al. | |
| 3,750,069 | A | | 7/1973 | Renskers | |
| 3,812,443 | A | | 5/1974 | Schroeder | |
| 3,824,514 | A | | 7/1974 | Hojnacki | |
| 3,843,908 | A | | 10/1974 | Priegnitz | |
| 4,024,438 | A | | 5/1977 | Priegnitz | |
| 4,209,826 | A | | 6/1980 | Priegnitz | |
| 4,530,563 | A | | 7/1985 | Brzezinski | |
| 4,842,352 | A | | 6/1989 | Sasaki et al. | |
| 4,926,151 | A | | 5/1990 | Morinaga | |
| 5,307,041 | A | | 4/1994 | Kato et al. | |
| 5,541,567 | A | | 7/1996 | Fogel et al. | |
| 5,760,669 | A | | 6/1998 | Dangler et al. | |
| 5,760,670 | A | | 6/1998 | Yeh et al. | |
| 5,789,712 | A | | 8/1998 | Barry et al. | |
| 5,796,324 | A | | 8/1998 | Ross et al. | |
| 5,923,237 | A | * | 7/1999 | Sato et al. | 336/212 |
| 6,055,721 | A | | 5/2000 | Mamada et al. | |
| 6,285,272 | B1 | | 9/2001 | Boyter et al. | |
| 6,294,975 | B1 | | 9/2001 | Chen | |
| 6,348,850 | B1 | * | 2/2002 | Kimura et al. | 336/200 |
| 6,414,583 | B1 | | 7/2002 | Yeh et al. | |
| 6,472,969 | B1 | | 10/2002 | Hanato | |
| 6,522,230 | B2 | * | 2/2003 | Hanato et al. | 336/83 |
| 6,535,095 | B2 | | 3/2003 | Aoki et al. | |

* cited by examiner

SURFACE MOUNTABLE ELECTRONIC COMPONENT

CROSS REFERENCE TO RELATED APPLICATIONS

This application claims the benefit of earlier filed U.S. Provisional Application No. 60/286,751, filed Apr. 26, 2001, and U.S. Provisional Application No. 60/289,100, filed May 7, 2001, under 35 U.S.C. §119(e).

BACKGROUND OF THE INVENTION

This invention relates generally to electronic components and more particularly concerns low profile surface mountable electronic components having an improved structure for increasing the performance of the component.

Over the last decade the electronics industry has made many advances with respect to electronic components. One of the more significant advances was the introduction of the Surface-Mount Device (SMD) or surface mount technology. SMDs allow electrical components to be mounted on one side of a PCB, without requiring the leads of the components to be inserted through the printed circuit board (PCB) and soldered to the reverse side of the PCB, (i.e., an older method of mounting components to PCBs referred to as through-hole technology). An SMD component has small metalized pads (terminals or leads) connected to its body, which correspond to solder pads (or lands) located on the surface of the PCB. Typically the PCB is run through a solder-paste machine (or screen printer), which puts a small amount of solder on the solder pads of the PCB. Then, the component is placed on the PCB, and the PCB is sent through a re-flow oven to heat the solder paste and solder the component leads to the PCB solder pads. The primary advantage to this technique is that both sides of the PCB can now be populated by electronic components. Meaning one PCB today can hold an amount of electrical components equal to two PCBs in the past.

As a result of this advancement in technology, the size of electronic circuits has decreased, thereby enabling smaller electronic devices to be manufactured. Current electronic circuits are mainly limited by the size of components used on the PCB. Meaning, if the electronic components can be made smaller, the circuits themselves can be made smaller as well. Unfortunately, there are some electronic components that have been more difficult to configure for SMD technology. For example, over the years many advances have been made in creating surface mount single winding components such as inductors. To date, however, there have only been minimal advances with respect to multi-winding components such as transformers. This is, at least in part, due to the difficulty in obtaining high quality multi-winding components that are robust enough to handle the conditions SMD components are exposed to during their production and use.

For example, in the conventional SMD transformer shown in FIG. 9, the component is constructed using a plastic bobbin (or coilform) upon which the windings of the component are wound. A problem with this configuration is that the plastic bobbins or coilforms are often times incapable of handling the extreme heat or high temperatures the component is exposed to during its manufacturing. A particular drawback to this type of component is the amount of warping or deformation the bobbin experiences when the component covered PCB (or populated PCB) passes through the re-flow oven in order to create the electrical connection between the component and the PCB. During this solder reflow stage, the populated PCB is heated to a high enough temperature (e.g., 200° C.–260° C.) to heat the metalized pads of the component and the corresponding lands on the PCB and to liquify the solder paste therebetween so that an electrical connection (or solder joint) can be established between the metalized pads and lands once the solder lowers in temperature. Often times, this temperature increase is enough to deform or warp the plastic bobbin causing the component and its solder joint to incur unwanted stress due to the deformation. Such deformations or warping may prevent the component from retaining its low profile shape or desired height from the surface of the PCB, and may cause the component or circuit to experience failures over their lifetime. For example, warping may induce enough strain on the solder joint to actually lift the land or solder pad and trace up from the PCB. Such an act can cause the trace or solder joint to break away formt he PCB creating an open circuit condition or a condition in which the circuit may only work intermittently.

In order to reduce the risk of such warping or deformation, the solder reflow stage could be conducted at a lower temperature; however, such an adjustment may result in the metalized pads, lands, and/or solder paste failing to reach a sufficient temperature to make a solid electrical and mechanical connection to the PCB. For example, if the metalized pad of the component does not heat to a sufficient temperature it may not bond with the melted solder paste causing a cold solder joint to be formed and resulting in either a poor/intermittent electrical connection between that pad of the component and its corresponding land on the PCB, or an open circuit condition in the circuit of the PCB.

Another drawback to using plastic bobbins for multi-winding components is that the component typically is required to use terminal pins extending out from the body of the component, thereby increasing the overall amount of space needed for the component. Given that the current desire in the industry is to make smaller components and smaller circuits, this increase in the space requirement for the component may make the component impractical for certain applications. Moreover, by having terminal pins extending from its side, the component leaves exposed current carrying coils and pins which can be shorted together by loose fragments within the circuit housing and/or inadvertently touched by individuals servicing or testing the electronic circuit. Thus, such a configuration allows for the component and circuit to be damaged, and increases the risk of electrical shock.

Although the terminal pins of the component of FIG. 9 are shielded by its core halves when assembled, other components using terminal pin configurations do not shield the exposed coil windings of the terminal pins which can increase the amount of noise, such as electromagnetic interference (EMI) and/or radio frequency interference (RFI), caused by the component. For example, with current running through the exposed coil windings, the electric or magnetic lines of flux of the component will be widely disbursed about the component. This increases the likelihood of the component causing interference with other components in the circuit and prevents the component from operating as optimally as it can due to disbursed flux lines.

The use of terminal pins also increases the cost for manufacturing the component because it requires the wire from the windings to be wound about the terminal pins and then dipped into a solder pool or bath, (i.e., dip soldering), in order to remove the wire insulation and create an electrical connection or solder joint between the wire winding and the terminal pin of the component. The need for additional equipment and/or manual labor to hand wind the component increases the cost of the component and makes it less likely to be used in a number of applications. Furthermore, when the component is dip soldered, the plastic bobbin is again exposed to high temperatures which may result in further warping or deformations.

Another problem associated with the shaped core and bobbin configuration of FIG. 9, is that it does not have a seamless flat top portion for allowing industry standard pick-and-place equipment to position the component on the PCB, and thus does not have a configuration that is easy to implement into the traditional tape and reel carrier format used by a majority of the electronics industry. Such a configuration also increases the cost of manufacturing the overall circuit by requiring specialized equipment for placement of the component, or by requiring manual placement of the component, which increases the amount of time and cost needed to fully assembly the circuit, making the component less likely to be used in a majority of applications.

A solution to several of the problems associated with plastic bobbins was created by Coilcraft, Incorporated of Cary, Ill., which involved replacing the plastic bobbin/terminal pin configuration with a component having a ceramic base, a core made of a magnetic material, and a flat top portion made of acrylic. As shown in FIGS. 10A–B, metalized pads are capable of being bonded directly to the ceramic base of the component so that the ends of the wire winding can be electrically connected to the component and the component can be electrically and mechanically connected to the PCB. This allows the component's terminals or metalized pads to be positioned below the component, without exposure of the wire winding, and also prevents the terminals or pads from increasing the overall size of the component (or amount of space the component takes up).

Further, the use of a base material having a high temperature tolerance, such as ceramic, allows the component to withstand the high temperatures of the solder reflow stage mentioned above (e.g., 200° C.–260° C.) without experiencing the warping or deformation that a plastic bobbin is subject to. Such a configuration also allows for mechanically strong materials such as ceramic to be used for the component making the device better equipped to handle the stresses and shocks it is likely to experience over its lifetime of use.

The configuration of the component of FIGS. 10A–B does not provide optimal shielding of the component or optimize the component operation by concentrating the flux lines of the component. The acrylic top portion provides a seamless flat surface with which the component can be positioned using traditional component placement equipment, but it does not provide the desired shielding of the component and/or fails to improve the electrical performance of the component by further concentrating the flux lines of the component. These problems have attempted to be solved via use of a cover made out of magnetic material such as that shown in FIGS. 11A–B, however, difficulties have been incurred in trying to keep a desired amount of distance between the cover and the winding or core. For example, with respect to the cover of the component from FIGS. 11A–B, the cover may inadvertently be placed into contact with the winding of the component.

Furthermore, the component of FIGS. 10A–B and 11A–B are not configured for handling multi-winding components consisting of windings of three or more wires. With the components only having four metalized pads, and each wire ending needing its own metalized pad, the components of FIGS. 10A–B and 11A–B cannot be configured with windings of more than two wires. Moreover, these components do not provide their manufacturer with the ability to use the same base structure for several different multi-winding components (e.g., windings of two separate wires, three separate wires, four separate wires, etc.). For example, the base of FIGS. 10A–B cannot be used to manufacture a multi-winding component having a winding consisting of two separate wires in one instance, and a multi-winding component having a winding of three separate wires in another instance. Nor do these components offer their manufacturer the ability to wire the components so that a wire's ends can be bonded to a variety of different terminal pads if desired. For example, if a winding of two separate wires was desired, in the component of FIGS. 10A–B the wires would be wound with the ends of the wire being bonded to metalized pads located near one another. In alternate embodiments, however, it may be desirable to distance the space between the wire ends, e.g., to meet a customer's desired land foot print on the PCB.

Accordingly, it has been determined that the need exists for a surface mountable electronic component having an improved structure for increasing the performance of the component and which overcomes the aforementioned limitations and further provides capabilities, features and functions, not available in current devices.

SUMMARY OF THE INVENTION

A low profile electronic component in accordance with the invention includes an elongated core, which is connected to a base having a plurality of metalized pads attached thereto for electrically and mechanically connecting the component to a printed circuit board. The component also includes support structures or spacers which are positioned at the ends of the core and, in combination with the core, serve to shield the component from interference and concentrate the magnetic lines of flux emitted by the component in order to increase the flux density and inductance of the component.

The component also includes a winding of wire wound about at least a portion of the base and core assembly between the supports, and has the ends of the wire electrically and mechanically connected to the metalized pads of the base. By positioning the winding of wire between the supports, the magnetic lines of flux of the component are condensed into a tighter concentration causing the flux density and inductance of the component to increase.

A top portion or shielding structure may be connected to the core via the supports (or spacers) in order to cover at least a portion of the windings of wire of the component to further shield the component. The supports separate the core and the top portion and maintain the top portion at a desired position with respect to the winding and the core. The top portion also concentrates the magnetic lines of flux of the component, thereby increasing its flux density and inductance. As such, the core, supports, and top portion provide a source of additional shielding for the component thereby reducing the amount of electro-magnetic interference and/or radio frequency interference caused by the component when mounted in a circuit on the PCB. This improves the performance of the component and optimizes it for use in a variety of applications.

In one embodiment the supports form an integral part of the core and are therefore made of the same material as the core. The base and core form an I-shaped assembly to which the top portion may be attached. In another embodiment, the supports form an integral part of the top portion and are made of the same material as the top portion. In yet another embodiment, the supports may comprise their own structure rather than being integral to the core or top portion and may be made of similar material to the core or top portion, or each component (the core, top portion and supports) may be made of different materials altogether.

A component made in accordance with the invention may also contain insulators for isolating the core from the top portion. In alternate embodiments, the insulators may comprise a portion of the supports or make up the entire support in and of itself. The insulators provide a gap between the top portion and the core which may be desirable in certain multi-winding components.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENTS

Figure 1A:
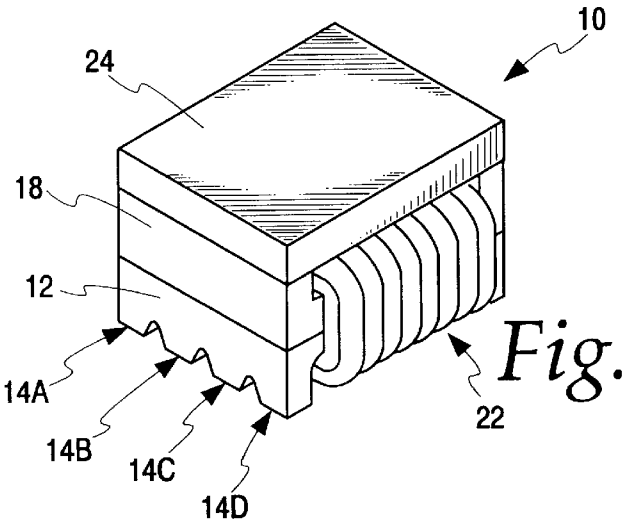
FIG. 1A is a perspective view of a low profile electronic component according to the invention.
Figure 1B:
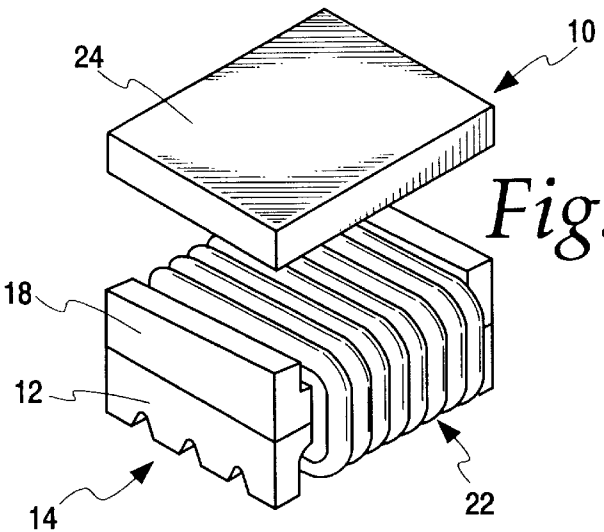
FIG. 1B is a partial exploded view of the electronic component from FIG. 1 showing the top portion exploded from the core base and winding of the component.
Figure 1D:
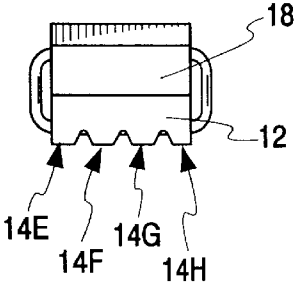
FIG. 1D is a right side elevational view of the electronic component from FIG. 1.

A low profile electronic component in accordance with the invention includes an elongated core made from a magnetic material such as ferrite, which is connected to a base having a plurality of metalized pads attached thereto for electrically and mechanically connecting the component to a printed circuit board. Support structures or spacers are positioned at the ends of the core and are provided to assist the core in shielding the component and concentrating its magnetic lines of flux. The component also includes a winding of wire wound about at least a portion of the base and core assembly between the supports, and has the ends of the wire electrically and mechanically connected to the metalized pads of the base. By positioning the winding of wire between the supports, the magnetic lines of flux of the component are condensed into a tighter concentration causing the flux density and inductance of the component to increase. A top portion may be connected to the core via the supports (or spacers) to cover at least a portion of the windings of wire of the component. The supports separate the core and the top portion and maintain the top portion at a desired position with respect to the winding and the core. The top portion further concentrates the magnetic lines of flux of the component, thereby increasing its flux density and inductance. As such, the core, supports, and top portion provide a source of additional shielding for the component thereby reducing the amount of electromagnetic interference and/or radio frequency interference caused by the component when mounted in a circuit on the PCB. This improves the performance of the component and optimizes it for use in a variety of applications.

Turning first to FIGS. 1A–F, a low profile electronic component in accordance with the invention is shown generally at reference numeral 10. In this embodiment the component 10 comprises a base 12 which is generally rectangular in shape and has a plurality of legs 14*a–h* extending downward therefrom, (collectively referred to as legs 14). The base 12 is preferably made from an insulative material having a high temperature tolerance and/or a low coefficient of thermal expansion, such as ceramic, in order to withstand the high temperatures the component is exposed to during its manufacture, assembly into circuits, and use. In a preferred form, the material selected will have a high temperature tolerance, (e.g., capable of withstanding 260° C. temperatures), and will have a coefficient of thermal expansion that is as close to the PCB's coefficient of thermal expansion as possible while still being able to withstand high temperatures.

Figure 1C:
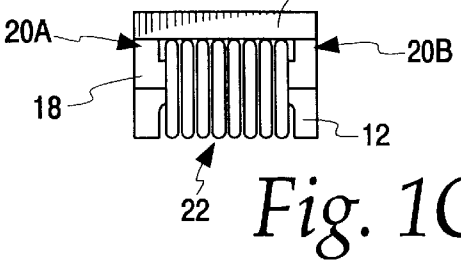
FIG. 1C is a front elevational view of the electronic component from FIG. 1.
Figure 1E:
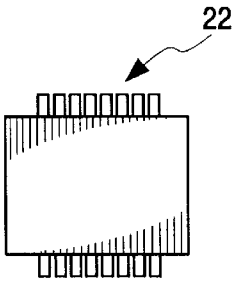
FIG. 1E is a top plan view of the electronic component from FIG. 1 showing the flat top portion which can be used by traditional component placement equipment.
Figure 1F:
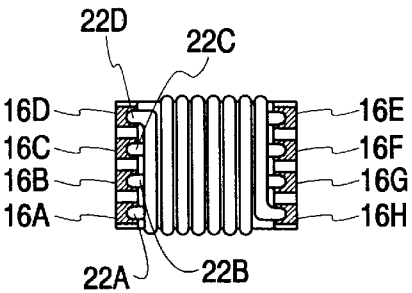
FIG. 1F is a bottom plan view of the electronic component from FIG. 1 showing the lower side of the windings and the metalized pads to which the wire ends are connected.
Figure 3C:
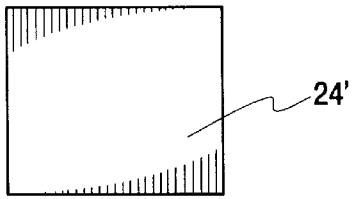
FIGS. 3A–D are front elevational, right side elevational, and top and bottom plan views of an alternate embodiment of an electronic component in accordance with the invention, in which the top portion consists of a cover made out of magnetic material having a flat top surface with walls extending downward therefrom.
Figure 3A:
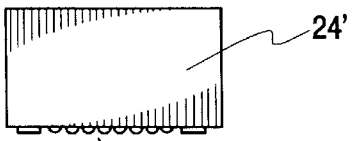
Figure 3B:
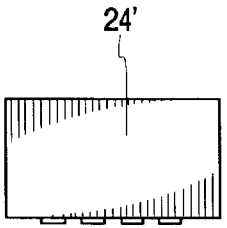
Figure 3D:
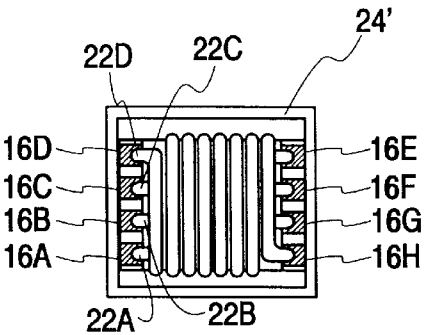
Figure 2:
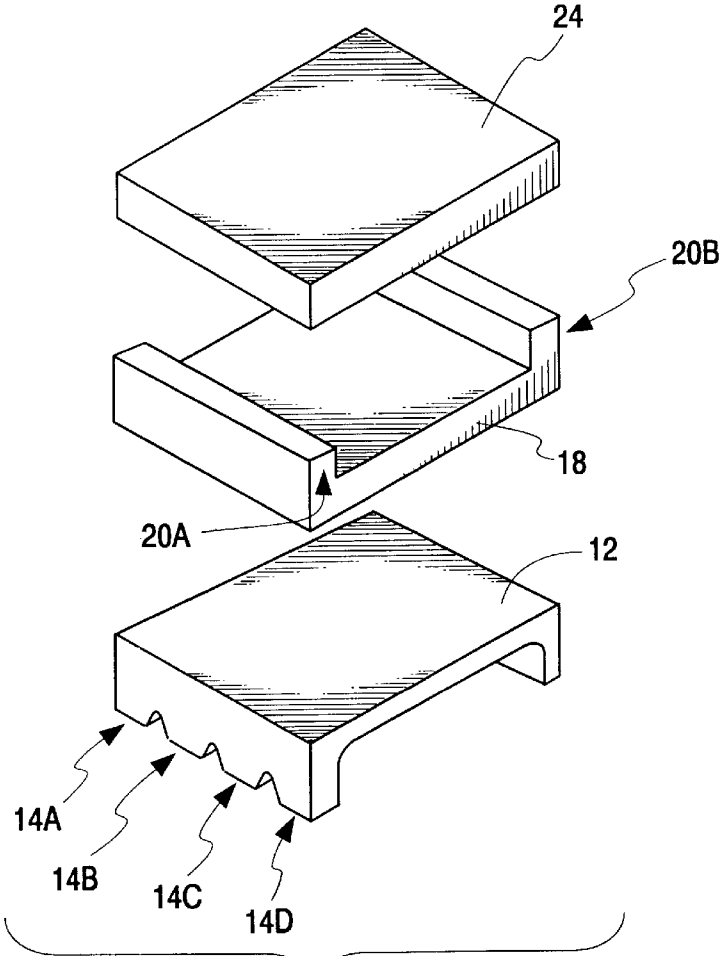
FIG. 2 is an exploded view of the electronic component from FIG. 1 showing the base, core and top portion without the coil or winding.

As shown in FIG. 1F, metalized pads 16*a–f* are connected to the bottom surface of the legs 14 and are used to electrically and mechanically connect the component to corresponding lands on a PCB. More particularly, the metalized pads 16*a–f* are bonded to the ceramic base 12 and provide an electrically conductive surface to which the solder paste printed on the PCB can bond once the component and PCB are passed through a solder reflow oven. The legs of component 10 are formed in an arched column format to further maximize the strength of each leg and the strength of the overall component.

The component 10 further includes an elongated core 18 which is connected to the upper surface of the base 12. In a preferred form, the core is made of a material that can be magnetized, such as a ferrite or other ferromagnetic material, and has supports 20*a* and 20*b* extending upward from its ends. In the embodiment shown, the supports 20*a–b* are integral pieces of the core 18 and are thus made of the same material as the core; however, in alternate embodiments the supports 20*a–b* may be separate structures and/or made from a different material than the core 18. An example of this will be discussed further below with respect to FIGS. 4A–C.

Figure 6A:
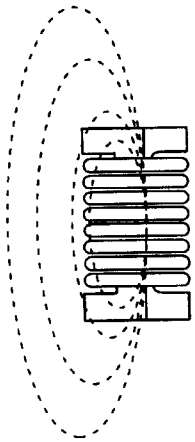
FIGS. 6A–C are front elevational views of electronic components in accordance with the invention illustrating the electric flux lines located about the component.

With such configurations, the base 12 and core 18 take on C-shapes as shown in FIG. 1C and are combined back-to-back to form an I-shaped core/base assembly about which the windings of the component 10 are wound. The core 18 and supports 20*a–b*, work together, collectively, to force the lines of flux generated by the component closer together, thereby increasing the flux density and inductance of the component. An illustration of this effect can be seen in FIG. 6A, which indicates how the flux lines located below, and to the side of, the core 18 have been concentrated. The treatment of the flux lines disbursed above the core/base assembly will be discussed in further detail below with respect to FIGS. 6B and C.

The electronic component 10 also has a winding of wire 22 which is wound about the I-shaped assembly made up of base 12 and core 18. In the embodiment shown in FIGS. 1A–F, the component winding is constructed of four separate wires 22*a–d*. The first wire 22*a* is wound about the core/base assembly and has its ends electrically and mechanically connected to metalized pads (or leads) 16*a* and 16*e*. This winding of wire may be referred to as the first winding. The second wire 22*b* is then wound over the first winding and about the core/base assembly to form a second winding. In a preferred embodiment, a layer of insulation tape is placed over the first winding before second wire 22*b* is wound thereon. In alternate embodiments, however, the second wire 22*b* may be wound directly onto the previous winding of wire 22*a*. The ends of the second wire 22*b* are connected to metalized pads 16*b* and 16*f*. The third wire 22*c* and fourth wire 22*d* are then similarly wound about the core/base assembly to form third and fourth windings, respectively. As mentioned above, these windings may either be wound directly onto the previous winding or on top of an intervening layer of insulation tape in order to keep the wires from coming into electrical contact with one another. The ends of the third wire 22*c* are electrically and mechanically connected to pads 16*c* and 16*g*, and the ends of the fourth wire 22*d* are electrically and mechanically connected to pads 16*d* and 16*h*.

In a preferred form, the ends of the wires 22*a–d* are flattened and bonded to the metalized pads 16*a–h* in order to minimize the amount of space between the lower surface of the metalized pads 16*a–h* and the upper surface of the PCB and/or the upper surface of the corresponding PCB lands. This helps maintain the low profile of the component 10 and also helps ensure that the component will remain co-planar when positioned on the PCB so that the pads 16*a–h* and wire ends will make sufficient contact with the solder paste on the PCB and will make solid electrical and mechanical connections to the circuit on the PCB. As shown in FIG. 1F, the metalized pads 16*a–f* provide sufficient surface area for the flattened ends of the wires 22*a–d* to be connected thereto.

Figure 6B:
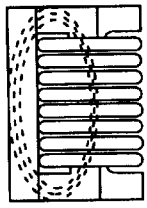

Component 10 further includes a top portion 24 which is connected to supports 20*a–b* and has a flat and seamless upper surface for allowing the component 10 to be positioned via industry standard component placement equipment (e.g., pick-and-place equipment). The top portion 24 is preferably made of magnetic material, similar to core 18, and is generally rectangular in shape thereby forming a slab over at least a portion of the windings of wire 20. The top portion effectively serves as a top core portion and, in conjunction with the core 18 (or lower core portion) and supports 20*a–b*, further concentrates the lines of flux of the component as can be seen in FIG. 6B. By forcing the lines of flux closer together, the core 18, supports 20*a–b*, and top portion 24 increase the flux density and overall inductance of the component 10, and improve the shielding of the component to minimize the amount of interference that is caused by its presence, (e.g., EMI, RFI, etc.). Thus, the configuration of component 10 serves to improve the electrical performance of the device.

In FIGS. 3A–D, an alternate top portion 24' is used in conjunction with component 10. In this embodiment, the top portion 24' consists of a cover made out of a magnetic material such as ferrite. The cover or top portion 24' is generally rectangular in shape with an elongated flat upper surface having outer walls extending downward therefrom. In the embodiment shown, the outer walls extend down over a majority of the winding 22 further shielding the component and concentrating the electric flux lines emitted thereby. This configuration not only improves the performance of the component 10, but also provides a source of protection for the current carrying windings or coils by serving as a means to prevent accidental shorting and/or electrical shock. Like the top portion of FIGS. 1A–F, the top portion 24' provides a seamless top surface with which industry standard component placement equipment can be used.

Figure 4C:
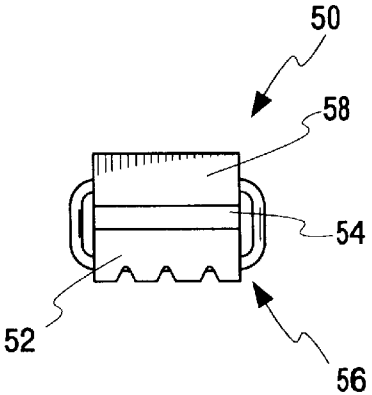
FIGS. 4A–C are partial exploded, front and right side elevational views of an alternate embodiment of an electronic component in accordance with the invention, in which the supports are attached to the top core portion rather than the bottom core portion.
Figure 4B:
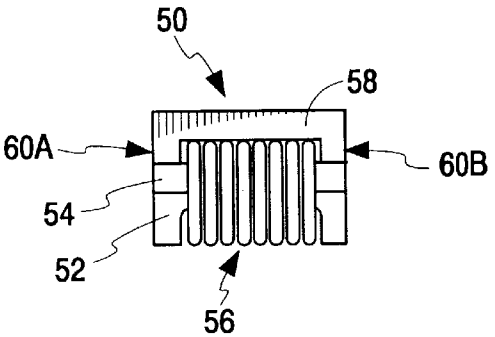
Figure 4A:
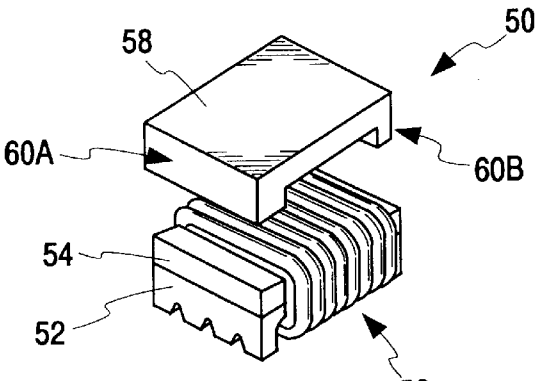

In FIGS. 4A–C, an alternate embodiment of a surface mountable component is shown and is referred to generally by reference numeral 50. In this embodiment, the component 50 is similar to the component discussed above with respect to FIGS. 1A–F, with the exception of having the supports integrated into the top portion rather than the core. More particularly, in this embodiment the core 54 consists of a generally flat rectangular slab of magnetic material which is connected to the upper surface of the base 52. A wire winding 56 is wound about the core/base assembly, with the ends of the wire being connected to the metalized pads located below the base 52. In the embodiment shown, the top portion 58 is generally rectangular in shape and has integral supports 60*a* and 60*b* extending downward therefrom. Like the supports discussed in FIGS. 1A–F above, supports 60*a* and 60*b* separate the top portion 58 from the core 54, and together with the core 54 and top portion 58 serve to shield the component 50 and concentrate the flux lines of the component to improve its performance. The flux line illustration of FIG. 6B is representative of the concentration of electric flux lines for component 50.

Figure 5C:
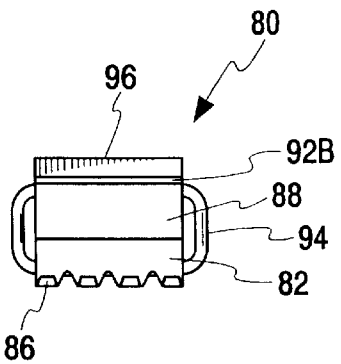
FIGS. 5A–C are partial exploded, front and right side elevational views of another embodiment of an electronic component in accordance with the invention, in which an insulator separates the top core portion from the bottom core portion.
Figure 5B:
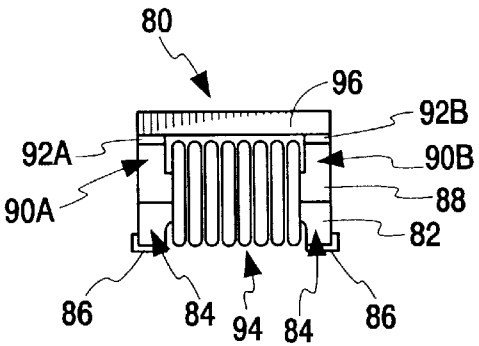
Figure 5A:
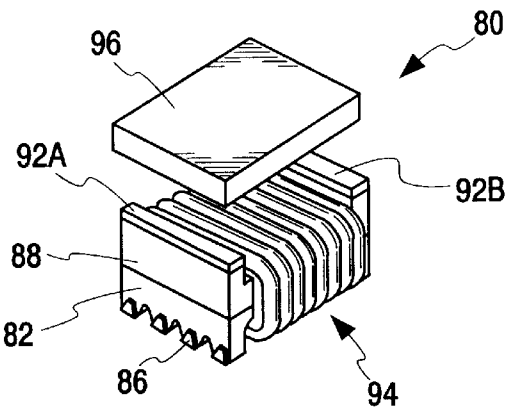

In FIGS. 5A–C another embodiment of a surface mountable electronic component is shown and is identified generally by reference numeral 80. In this embodiment, the configuration of the component 80 is similar to that of component 10, with the exception of having an insulator present between the core and top portion and having L-shaped metalized pads mounted to the base. More particularly, the base 82 consists of a material having a high temperature tolerance such as ceramic and has a plurality of legs 84 extending downward from the ends of the base 82. Metalized pads 86 are connected to the outer side, and bottom, surfaces of the legs 84 and are made from an electrically conductive material. The pads 86 are preferably L-shaped in order to strengthen the coupling between the metalized pad and the base 82, and in order to strengthen the solder connection created between the component 80 and the lands on the PCB. For example, by providing an additional pad portion along the side of the component, rather than just below the component, the overall size of the metalized pad is increased and can have more solder applied thereto. The increase in pad size and increase in the amount of solder strengthens the solder joint connecting the component to the PCB. Furthermore, by increasing the pad size the surface area connecting the metalized pad to the base is increased which strengthens the connection between the pad and the base. Similar benefits may be achieved by using an alternate U-shaped pad as well.

Another benefit of providing metalization on the outer side wall of the legs 84 or base 82, is that the solder joint of the component 80 becomes more visible which allows an individual to visually inspect the solder joint when needed. This visibility may help technicians perform rework or removal of the component from the PCB when needed and/or provides an easily accessible area for the placement of probes, such as oscilloscope probes, when using test equipment to test the circuit of the PCB. For example, if the solder pads are only located below the base or legs of the component and the corresponding lands, (to which the component is soldered), do not stick out a sufficient amount to position the tip of a soldering iron or probe thereon, the component can be more difficult to rework, remove and/or probe. In certain circumstances, such a configuration may also reduce the risk that damage will be done to the component and/or the circuit of the PCB. For example, in an attempt to remove a difficult component, a technician may over heat the solder joint causing the trace and solder pad (or land) to lift up from the surface of the PCB. Such an act severely compromises the integrity of the circuit on the PCB and is likely to result in the scrapping of the circuit.

Figure 6C:
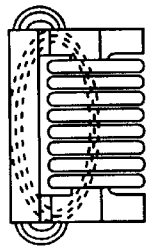

In addition to the alternate pads shown in the embodiment of FIGS. 5A–C, alternate cores, supports and top portions may be used in accordance with the invention as well. In FIGS. 5A–C, core 88 is connected to the upper surface of the base 82 and consists of a generally rectangular shaped magnetic material such as ferrite having integral supports 90*a–b* extending upward therefrom. Winding 94 is wound about the core/base assembly and is connected to the metalized pads of the base. Located at the ends of the supports 90*a–b* are insulators 92*a–b* which, like the base 82, are preferably made from materials having high temperature tolerances such as ceramic. The insulators 92*a–b* serve to electrically isolate the core 88 from top portion 96 and provide a gap between the core 88 (or bottom core) and the top portion 96 (or top core). This configuration is desirable in some multi-winding components such as transformers in which gaps between the core portions 88 and 96 are desired. An illustration of the electric flux lines of this component is shown in FIG. 6C. In a preferred form, the component 80 is provided in standard sizes having gaps of 0.001", 0.002" or 0.005".

In alternate embodiments of component 80, any number of different gap sizes may be provided and/or the component 80 may be configured similar to the component 50 of FIGS. 4A–C. For example, the top portion 98 may be C-shaped having integral supports 90*a–b* extending downward therefrom and having insulators 92*a–b* located at the bottom thereof. In another embodiment, an insulative coating such as Parlene may be used over the supports, the top portion, or both, in order to provide the desired gap. Furthermore, in alternate embodiments of the components discussed herein, the supports for each component may be their own structure instead of integral portions of the core or top portions. For example, the supports may comprise insulators such as ceramic which are used to separate the top portion from the core and/or maintain a desired distance therebetween. With such a configuration, both the core and the top portion may consist of generally flat rectangular shaped slabs being separated by insulative standoffs.

Figure 7B:
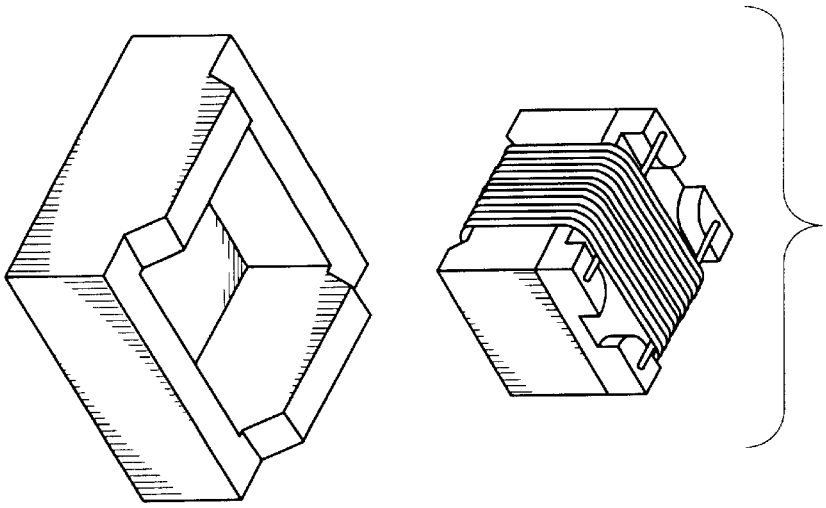
FIGS. 7A–B are perspective and partial exploded views of an alternate electronic component in accordance with the invention, showing an alternate top portion or cover and alternate base legs.
Figure 7A:
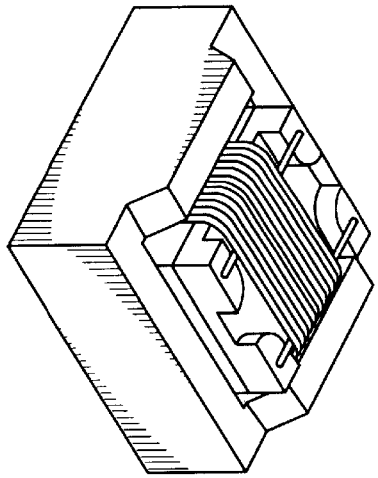

In FIGS. 7A–B, another embodiment of a surface mountable electronic component in accordance with the invention is shown and is identified generally by reference numeral 100. With this component 100, an alternate base 102 is used, which contains an alternate set of legs 104 and metalized pads 106 that may be used to connect the component to a PCB. More particularly, the base 102 is made from ceramic or material having similar thermal properties and strength, and has four legs 104 extending downward therefrom. Metalized pads 106 are connected to the lower surface of the legs 104 and are used to electrically and mechanically connect the ends of wires 108*a* and 108*b* to the component 100 and to electrically and mechanically connect the component 100 to the PCB. Connected atop the base 102 is core 110 which is made of a ferrite or other material capable of being magnetized. The core 110 has integral supports 112*a–b* extending upward from the ends thereof. The supports serve to separate the core 110 from the inside upper surface of top portion 114 and to maintain the top portion 114 at a desired position with respect to the wire winding 108 and/or core 110.

As can be seen in FIGS. 7A–B, the top portion 114 consists of a cover made of a magnetic material, and preferably ferrite. The top portion 114 has a generally flat top surface with outer walls extending downward therefrom. The side walls of top portion 114 contain projections 114*a* and 114*b* which extend farther below the remainder of the side walls and serve to cover the that portion of the windings that wraps around the base 102. With such a configuration, the windings located on the front and rear surfaces of the component can be completely covered, without requiring the entire width of these surfaces to be covered, thereby saving on material costs and eliminating unnecessary portions of top portion 114 which do not further improve the performance of the component.

Figure 8A:
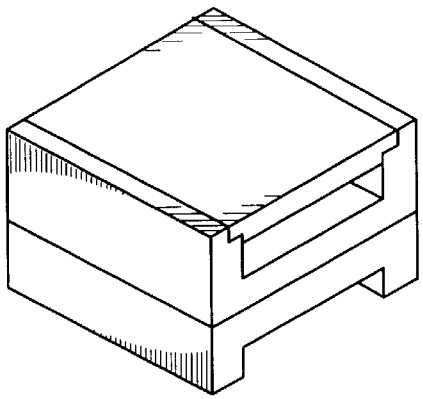
FIGS. 8A–D are perspective views of alternate electronic components in accordance with the invention showing various ways in which the top portion of the component may be connected to the core portion.
Figure 8B:
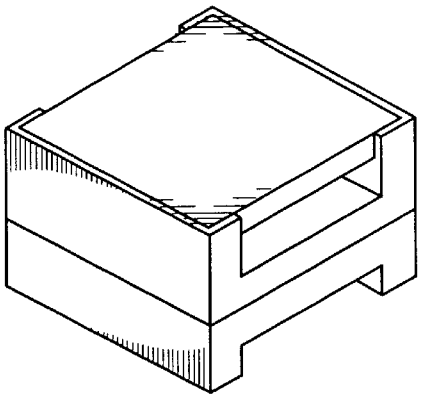
Figure 8C:
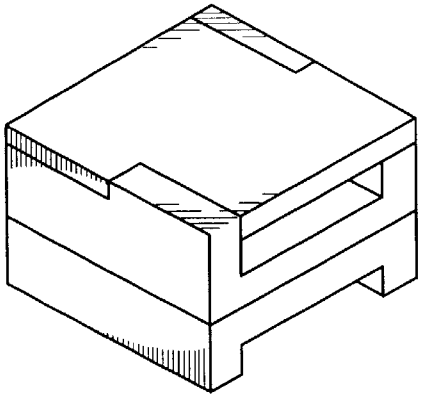
Figure 8D:
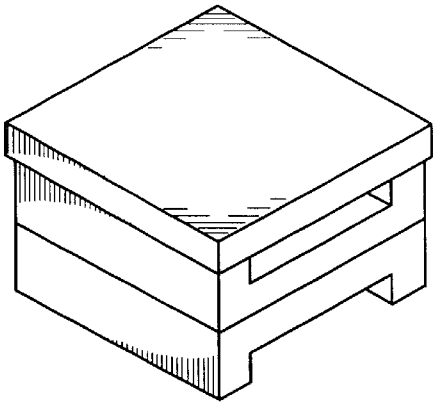
Figure 9:
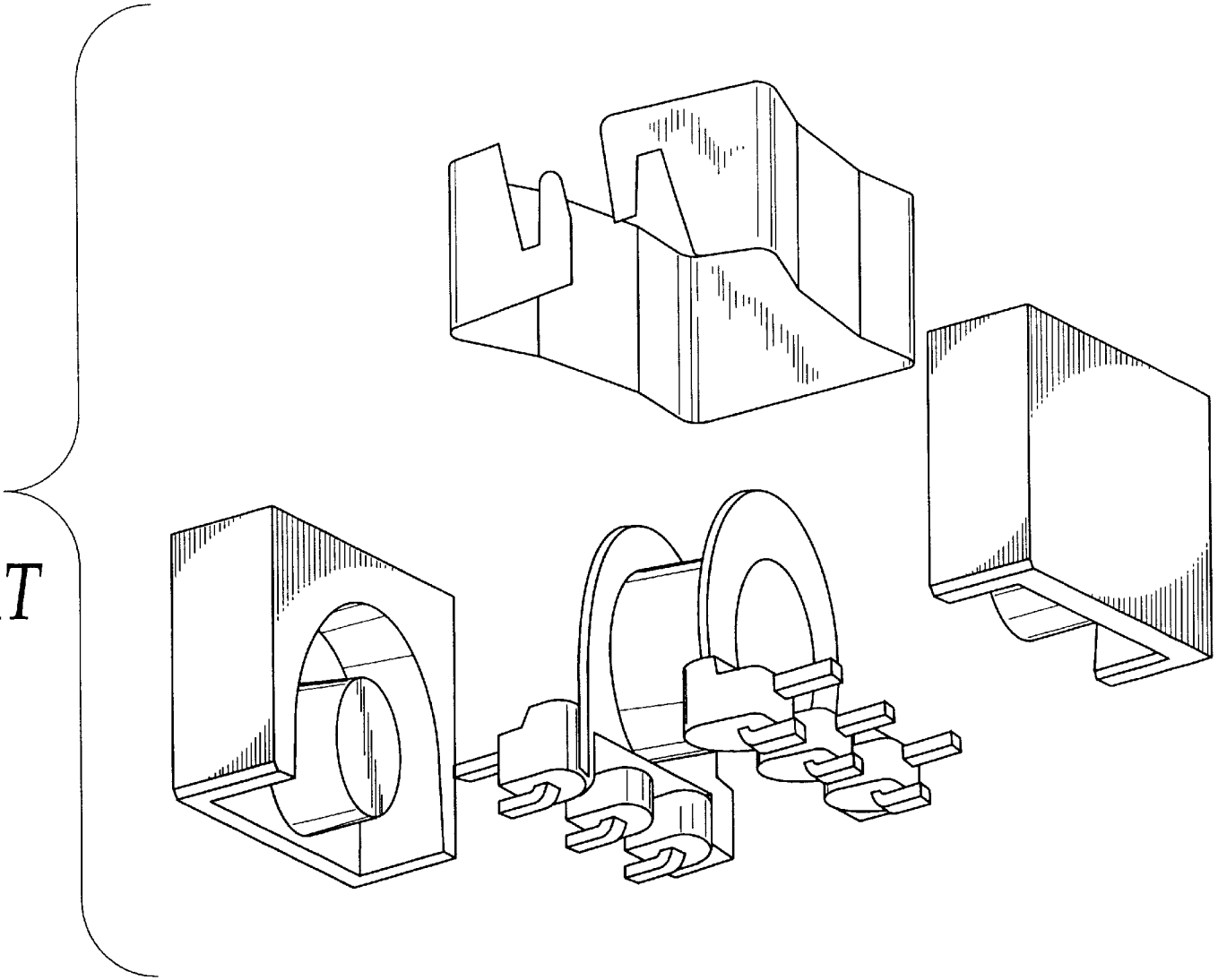
Fig. 9 PRIOR ART
FIG. 9 is an exploded view of a transformer known in the art comprising a plastic bobbin, core and core clamp. The wire windings for the component are wound about the plastic bobbin and about the upper terminal pins extending out from the side of the bobbin or coilform.
Figure 10B:
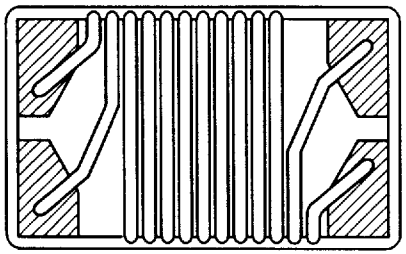
Fig. 10B PRIOR ART
FIGS. 10A–B are front elevational and bottom plan views of another multi-winding component known in the art.
Figure 11B:
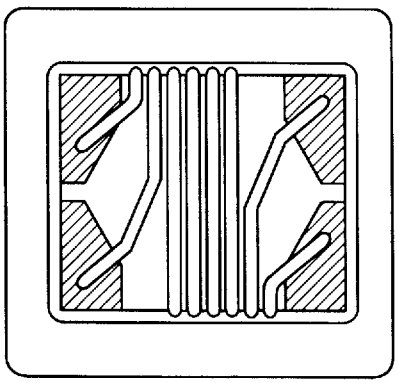
Fig. 11B PRIOR ART
FIGS. 11A–B are front elevational and bottom plan views of a multi-winding component having a cover made of a magnetic material which is also known in the art.
Figure 10A:
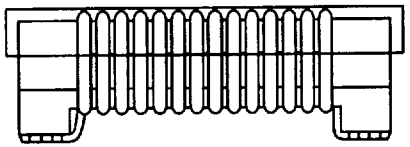
Fig. 10A PRIOR ART
Figure 11A:
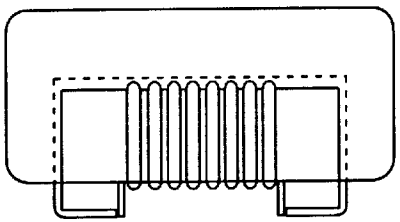
Fig. 11A PRIOR ART

In yet other embodiments of components made in accordance with the invention, cores and top portions of a variety of different configurations may be used. For example, in FIGS. 8A–D, a variety of core/top portion configurations are illustrated. In FIG. 8A, a lip is used on the top surface of the core to capture the top portion of the component. To further aid in the assembly of the component, the configuration of the core and top portion may be formed in a way that aids in the assembly of the component. For example, the configuration of FIG. 8A provides a means for positioning the top portion over the core so that the top portion is captured in one dimension. In FIG. 8B, a core lip similar to that in FIG. 8A is used, however, with this configuration the core is captured in two dimensions. In FIG. 8C, a shaped top portion is used in order to align the top portion over the core and allow the core to capture the top portion in two dimensions. In FIG. 8D, inserts are located within the bottom surface of the top portion for receiving the corresponding lip portions of the core. Such a configuration aids in the assembly of the component by providing a structure and means for positioning the top portion on the core and for capturing the top portion in at least one dimension.

Thus, in accordance with the present invention, an electronic component is provided that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A surface mountable electronic component comprising:

an elongated core of magnetic material having first and second ends;

a base of heat tolerant material supporting the core and having metalized pads located on a surface thereof for electrically connecting the base to a printed circuit board;

a winding of wire wound about at least a portion of the base and core, the winding of wire having ends electrically connected to the metalized pads of the base; and spacers of magnetic material extending from the ends of the core and having at least a portion of the winding of wire wound therebetween.

2. A component according to claim 1, wherein the base comprises a ceramic structure having at least six metalized pads located on a bottom surface thereof.

3. A component according to claim 2 comprising:

a shielding structure of magnetic material coupled to the spacers and covering at least a portion of the winding of wire.

4. A component according to claim 1, wherein at least a portion of the spacers comprise insulative material used to isolate the core from the shielding structure.

5. A surface mountable electronic component comprising:

an elongated core of magnetic material;

a base of heat tolerant material supporting the core and having metalized pads located on a surface thereof for electrically connecting the base to a printed circuit board;

a winding of wire wound about at least a portion of the base and core, the winding of wire having ends electrically connected to the metalized pads of the base;

a shielding structure of magnetic material covering at least a portion of the winding of wire; and spacers for spacing the shielding structure with respect to the coil and core.

6. A component according to claim 5, wherein the spacers are integral to the core forming a C-shaped assembly of magnetic material capable of concentrating lines of flux emitted from the component in order to increase flux density and inductance of the component.

7. A component according to claim 5, wherein the base comprises a C-shaped ceramic to which the metalized pads can be connected for electrically connecting the ends of the wire to the component and for electrically connecting the component to the printed circuit board.

8. A component according to claim 5, wherein the shielding structure comprises a generally rectangular shaped slab made from magnetic material capable of increasing flux density and inductance of the component.

9. A component according to claim 5, wherein the shielding structure comprises a cover made from a magnetic material and having a flat top surface with walls extending downward therefrom which serves to further increase flux density and inductance of the component.

10. A component according to claim 5, wherein the spacers are integral to the shielding structure forming a C-shaped assembly of magnetic material capable of concentrating lines of flux emitted from the component in order to increase flux density and inductance of the component.

11. A component according to claim 5, wherein at least a portion of the spacers comprise insulative material used to isolate the core from the shielding structure.

12. A component according to claim 5, wherein the spacers comprise a means for spacing the shielding structure with respect to the core.

13. A surface mountable electronic component having a base with a plurality of metalized pads arranged so that the component can be wired in a plurality of different component configurations comprising:

an elongated core of magnetic material;

a ceramic base coupled to the core and having a plurality of metalized pads for electrically connecting the base to a printed circuit board and for allowing the component to be wired in a plurality of different configurations, wherein the plurality of metalized pads comprises at least six pads and the plurality of different configurations comprise one of a single wire winding configuration, a double wire winding configuration and a triple wire winding configuration; and a winding of wire wound about at least a portion of the base and core, wherein the wire has ends which can be electrically connected to the metalized pads of the base.

14. A component according to claim 13, further comprising:

a shielding structure of magnetic material coupled to the core and covering at least a portion of the winding in order to concentrate magnetic lines of flux emitted from the component and increase flux density and inductance of the component.

15. A component according to claim 14, wherein the shielding structure comprises a generally rectangular shaped slab capable of increasing flux density and inductance of the component.

16. A component according to claim 14, wherein the shielding structure comprises a cover having a flat top surface with outer walls extending downward therefrom which serve to increase flux density and inductance of the component.

* * * * *